United States Patent [19]

Engman

[11] 3,955,746

[45] May 11, 1976

[54] PACKAGE MADE FROM PAPER, CARDBOARD, CELLULAR CARDBOARD AND LIKE MATERIALS

[75] Inventor: Per Olof Christer Engman, Hagersten, Sweden

[73] Assignee: Svenska Traforskningsinstitutet, Stockholm, Sweden

[22] Filed: Dec. 5, 1973

[21] Appl. No.: 421,800

[30] Foreign Application Priority Data

Dec. 12, 1972 Sweden ..... 16205/72

[52] U.S. Cl. ..... 229/37 E

[51] Int. Cl.[2] ..... B65D 5/02

[58] Field of Search ..... 229/37 R, 37 E, 48 T; 93/58 R, 36

[56] References Cited

UNITED STATES PATENTS

| | | | |
|---|---|---|---|
| 2,789,483 | 4/1957 | Hose | 93/58 R |
| 3,340,778 | 9/1967 | Boone et al. | 93/58 R |
| 3,374,715 | 3/1968 | Koning, Jr. | 93/58 R |
| 3,581,973 | 6/1971 | Turpin | 229/37 E |

*Primary Examiner*—Leonard D. Christian
*Attorney, Agent, or Firm*—Oldham & Oldham Co.

[57] ABSTRACT

A package or container made of paper or like material having a number of planar panels which are reinforced solely in narrow zones extending along the panel edges by a thermoset resin impregnating the material. A package forming method of locally impregnating a package blank in load carrying areas with a thermosetting resin.

7 Claims, 5 Drawing Figures

Figure 1:
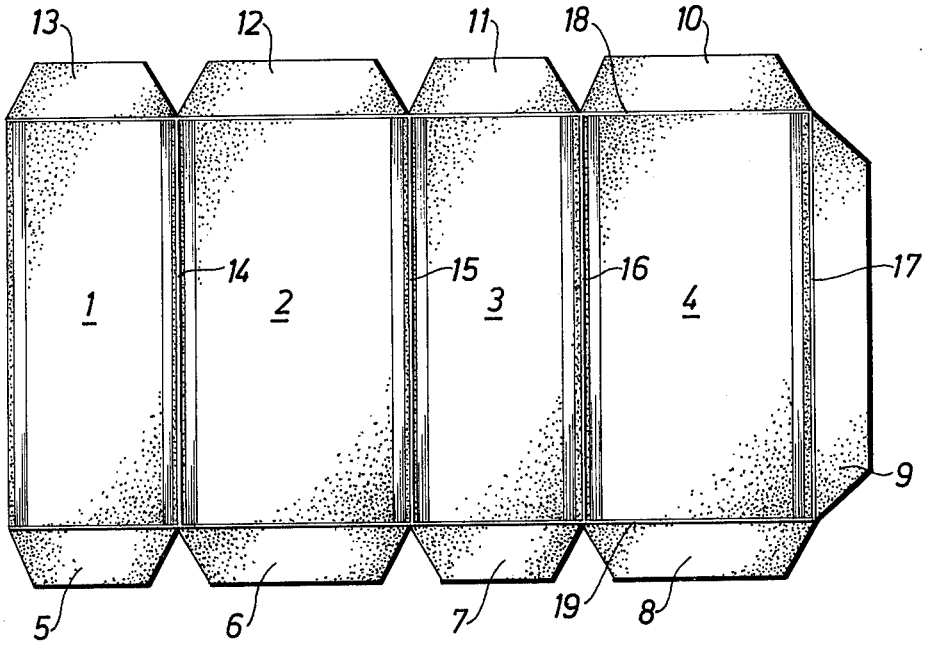

15 kp
10
5
10
20
30
40
50
%

15 kp
10
5
5
10
15
20 %

PACKAGE MADE FROM PAPER, CARDBOARD, CELLULAR CARDBOARD AND LIKE MATERIALS

The present invention relates to an improvement in packages which are made from paper, cardboard, corrugated cardboard and like materials and which are strengthened by impregnating the package material with a thermosetting resin.

It is known to strengthen packages made of paper-like material, such as cardboard boxes, cartons and like containers by impregnating the paper-like material with a thermosetting resin, which is caused to harden subsequent to erecting the package. The impregnating substance can be applied prior to punching-out the blank from which the package is formed and to providing said blank with fold lines, or to the package blanks incorporating the fold lines, or to be finished packages. The main purpose of providing the package with strengthened zones is to increase the ability of the package to withstand compression loads, e.g. when several packages are stacked one on top of the other. Previously, the packages have always been impregnated so that at least those portions of the package which extend vertically in the normal position of the package are impregnated in their entirety. One of the disadvantages with this method, however, is that the package material cannot be reconstituted for use as new paper material.

The object of the present invention is to provide a reinforced package with which there is used a minimum of impregnating agent and which has a mechanical strength comparable with and even greater than that achieved with hitherto known methods. Another object of the invention is to provide a package having considerably improved wet and dry strength in comparison with packages produced in accordance with known methods. Yet another object of the invention is to provide a package of the aforementioned type with which the major portion of the material from which the package is made can be reused as paper material.

Accordingly, the present invention relates to a package made of paper, cardboard, corrugated cardboard and like materials comprising a number of planar panels which are reinforced by impregnating the same with a thermosetting resin, the invention being mainly characterized in that the reinforced panels are solely impregnated in narrow zones extending along the edges of said panels.

It has been found that in order for the planar panels to absorb compression loads it is only necessary to ensure that the edge zones of said panels are reinforced, since when exerting a pressure force on the package the major portion of the force will only act against the edge zones of the package panels. Thus, with respect to the ability of the package to withstand compression loads, nothing is really gained by impregnating the whole of the package panel. As prevously mentioned, with the present invention the reinforcing impregnating agent is concentrated to those zones of the package where reinforcement is actually needed. It will be understood from this that a fully equivalent strengthening of the package, or even enhanced strengthening of said package is obtained by using considerably smaller quantities of impregnating agent than those used with previously applied methods, in which methods at least the panels which are expected to be subjected to compression load, e.g. the vertically extending panels in the position of use of the package, were impregnated over their entire area. One important and valuable improvement afforded by the present invention is the considerably improved wet strength of the package obtained. The width of the impregnated zones extending along the package corners subjected to load may vary in accordance with the size of the package, although in general the width of said zones reaches to between the limits of 1 and 20 percent, particularly 2 – 10 percent of the extension of the panel in question perpendicular to the longitudinal direction of the zone. For example, with average sized packages the width of the impregnated zones may be between 1 – 10 mm. The impregnated zones may include the actual corner of the package (in which case the impregnating agent must be hardened after the package is erected) or the corner may be left entirely free of impregnating agents. One important criterion is that the impregnating agent penetrates the entire thickness of the material from which the package is made. The desired degree of reinforcement is not obtained if only an external layer of the package material is impregnated.

The thermosetting resin used can be phenol-formaldehyde resin. Other resins normally used for impregnating paper mterial to strengthen the same may also be used, however. The resin is applied in the form of a solution, the type of solvent used and the concentration of the resin being preferably such that the solution is able to penetrate the material to provide the desired degree of impregnation.

The impregnating agent can be applied to the material in conjunction with punching-out the package blank and providing the same with fold lines, for example by means of the devices used to provide said blank with said fold lines or the anvil surfaces employed therewith, or both. The impregnating agent can also be applied to the material in a separate step by printing techniques, the impregnating agent being applied in this instance before the blank is punched out and provided with fold lines. In either case the impregnating agent may be applied to solely one side of the paper or to both sides, although in the latter case an intermediate hardening step may optionally be employed. The thermosetting resin may be hardened before or after punching out the blank and providing the same with fold lines or optionally subsequent to erecting the package. As previously mentioned, this latter alternative must be applied when the actual fold zone (i.e. the corners) are to be reinforced.

Figure 2:
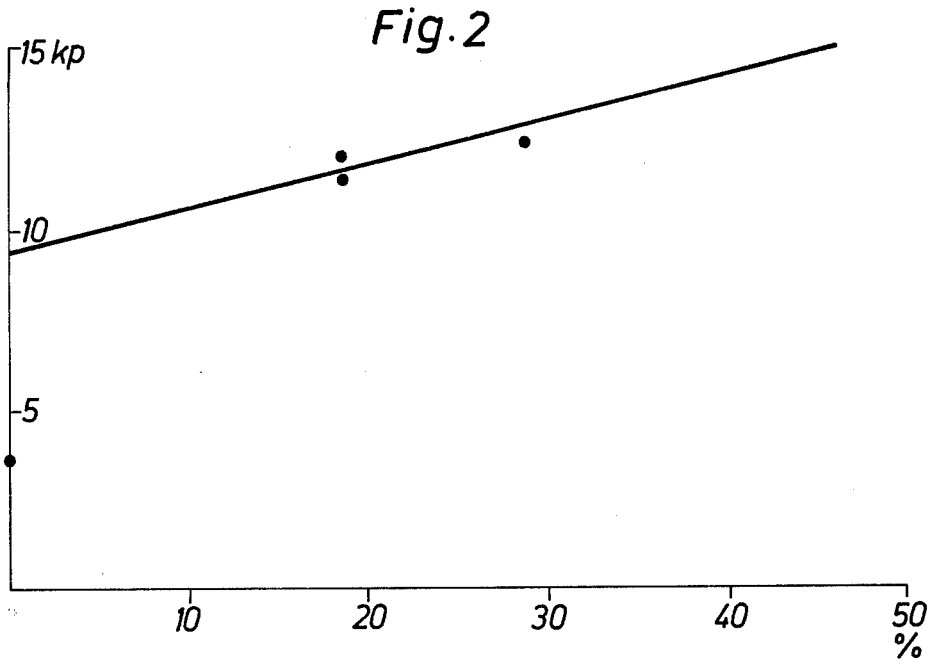
Figure 3:
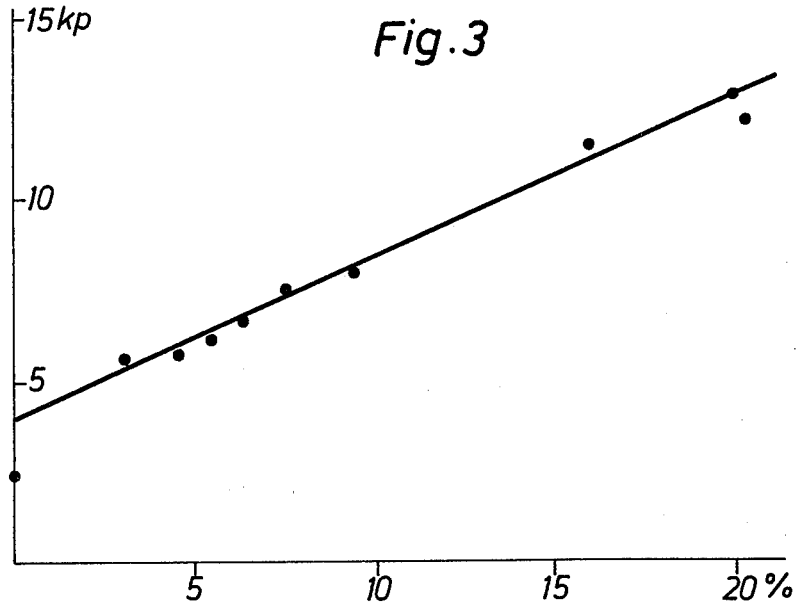
Figure 4:
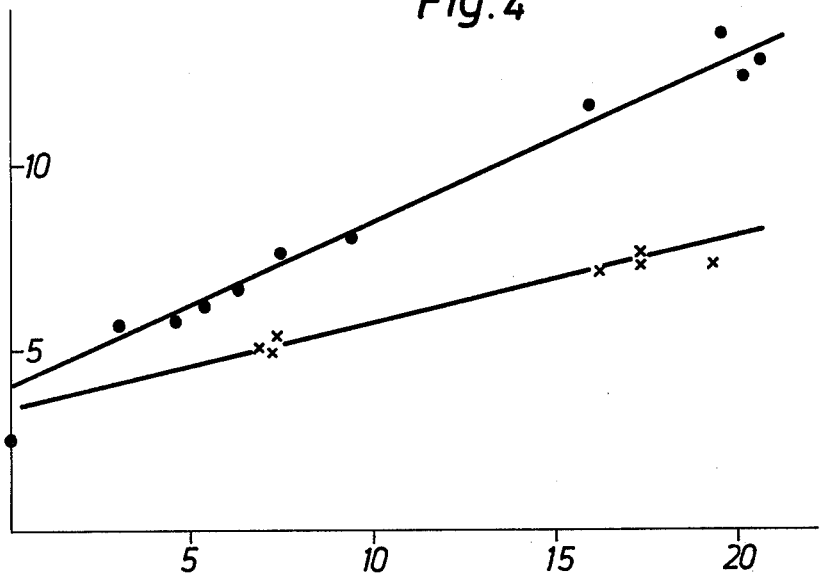
Figure 5:
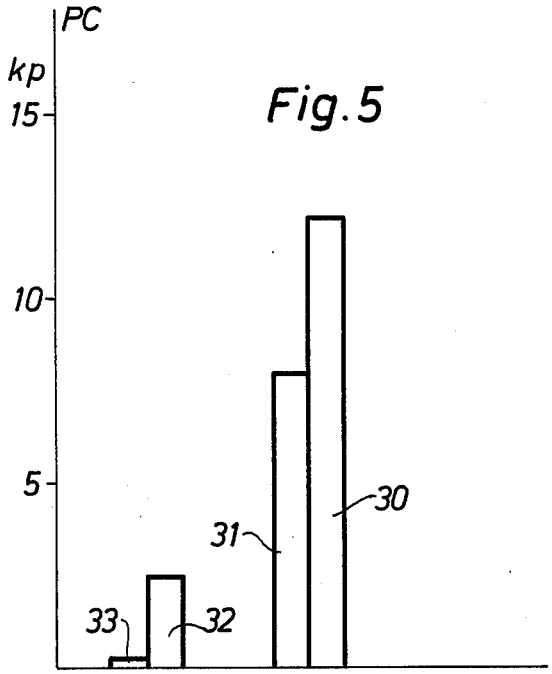

The invention will now be described in more detail with reference to the following drawing, in which FIG. 1 shows a package blank impregnated in accordance with the invention, FIGS. 2 and 3 are diagrams showing the increase in strength otained with a package impregnated in accordance with the invention, FIG. 4 is a diagram showing a comparison between a package impregnated in accordance with the invention and a package impregnated according to conventional techniques, and FIG. 5 is a diagram showing the dry and wet strength of a package when impregnated in accordance with the invention and the wet and dry strength of an untreated sample.

FIG. 1 shows a conventional blank for a cardboard box having four panels 1, 2, 3, 4 which, when the box is in use form vertical walls, and flats 5 – 13 for securing the panels to box form. The flaps are separated by vertical and horizontal fold lines 14 – 17, 18 and 19. As shown on the drawing, the blank is impregnated along the vertical fold lines 14 – 17 and the free edge of the panel 1. With the illustrated embodiment, the actual fold zone is not impregnated and hence the thermosetting resin can be hardened before the box is erected. The panels of the illustrated example are reinforced to take up compression forces acting vertically on the panels 1 – 4, e.g. when the packages are stacked one on top of the other. If the packages, however, are expected to be subjected to compression forces acting at right angles thereto, similar impregnated zones can be provided along the horizontal fold lines 18, 19.

The effect otained when impregnating paper material in accordance with the invention has been tested by treating pieces of cardboard in accordance therewith and subjecting said cardboard to vertical loads. FIGS. 2 and 3 show the result of such tests. In the illustrated case there were used cardboard pieces of 90 – 60 cm in size having a thickness of 0.56 mm (FIG. 2) and 0.48 mm (FIG. 3). The impregnating agent used comprised a solution of a commercially available phenolformaldehyde resin and was applied in narrow zones along the long edges of the cardboard pieces and hardened. The cardboard pieces were then loaded in a direction parallel with the long edges until fracture occurred. FIGS. 2 and 3 show the requisite force in kilograms as a function of the amount of impregnating agent in percent of the weight of the cardboard piece. In both cases the value obtained with an untreated cardboard piece of the same composition has been included.

FIG. 4 shows the result obtained when impregnating different cardboard pieces with the same impregnating agent, the impregnating agent being applied solely to the edges zones (the upper curve) in accordance with the invention and over the whole of the cardboard piece (the lower curve). As will be seen, a considerably improved reinforcement is obtained when the impregnating agent is only applied to the edge zones and when the same quantity of impregnating agent is used.

FIG. 5 shows the compression strength of a cardboard piece treated in accordance with the invention in a dry state (column 30) and in a wet state (column 31), and an untreated cardboard piece in dry and wet state (columns 32 and 33). The superior and surprising wet strength obtained with the cardboard treated in accordance with the invention is clearly shown in the diagram.

One important advantage afforded by the invention is that practically all the material used in the package can be reconstituted for further use. Only the narrow treated zones are unsuitable for further use.

I claim:

1. A method for producing a package having a number of planar panels therein by punching a blank from paper, cardboard, corrugated cardboard and like material, providing said blank with fold lines, impregnating the material with a thermosetting resin only within narrow zones along such fold lines and at the edges of the blank which in the erected state of the package form corners or edges subjected to compression loads, the remainder of the material of the blank being free from such impregnating substance, and erecting the blank to form a package, the thermosetting resin being hardened to provide reinforcing zones in the package.

2. A method according to claim 1, wherein the material is impregnated in predetermined localized areas prior to punching the blank and providing the same with fold lines.

3. A method according to claim 1, including forming the impregnating zones at corner forming areas of the blank but leaving the fold zone unimpregnated.

4. A method according to claim 1, wherein the material is impregnated when punching out the blank and providing the same with fold lines.

5. A method according to claim 2, wherein the thermesetting resin is hardened before the blank is punched out and provided with fold lines.

6. A method according to claim 1, wherein the thermosetting resin is hardened after punching out the blank and providing same with fold lines.

7. A method according to claim 1, wherein the thermosetting resin is hardened subsequent to erecting the blank to a package.

* * * * *